United States Patent [19]

Haswell

[11] 4,055,977

[45] Nov. 1, 1977

[54] METHOD AND APPARATUS FOR MAKING DOUBLE GROOVE PULLEYS

[76] Inventor: John W. Haswell, 44429 Harmony Lane, Belleville, Mich. 48111

[21] Appl. No.: 765,974

[22] Filed: Feb. 7, 1977

[51] Int. Cl.[2] ..... B21H 1/00

[52] U.S. Cl. ..... 72/84; 72/106; 72/110; 29/159 R

[58] Field of Search ..... 72/84, 105, 106, 110; 29/159 R

[56] References Cited

U.S. PATENT DOCUMENTS

| | | | |
|---|---|---|---|
| 3,654,790 | 4/1972 | Zatko | 29/159 R |
| 3,953,995 | 5/1976 | Haswell et al. | 72/84 |
| 3,977,264 | 8/1976 | Sproul | 29/159 R |

*Primary Examiner*—Lowell A. Larson

*Attorney, Agent, or Firm*—McNenny, Pearne, Gordon, Gail, Dickinson & Schiller

[57] ABSTRACT

An apparatus is provided for forming a pulley having at least two grooves from a cup-shaped metal blank having an axially extending sidewall. The blank is rotated about its longitudinal axis and is crushed between axially closing dies. As the blank is being crushed, an inner forming roll positioned within the cup is translated radially away from the longitudinal axis of the cup and into contact with the inner periphery of the cup. A rough forming roll is translated radially into contact with the outer periphery of the cup and applies forming pressure at a location radially offset from the area of contact of the inner forming roll. A finish forming roll is radially aligned with the rough forming roll and is translated radially toward the outer periphery of the cup. The rough and finish forming rolls are carried by cam-actuated slide assemblies arranged to move the rough roll into the blank wall in advance of the finish roll in a working operation so as to partially form a pulley groove and to maintain the finish roll in the partially formed groove in an idling operation. Thereafter, the rough roll is disengaged from the partially formed pulley groove and the finish roll is advanced to the root of the partially formed groove and into a working operation to form the finish groove against the inner roll.

8 Claims, 4 Drawing Figures

METHOD AND APPARATUS FOR MAKING DOUBLE GROOVE PULLEYS

BACKGROUND OF THE INVENTION

This invention relates generally to the art of forming one-piece, multiple groove pulleys from cup-shaped pulley blanks. There are significant problems in manufacturing concentric one-piece, single groove pullelys, and those problems are compounded in the manufacture of multiple groove pulleys. For example, in a double groove pulley, the grooves are separated by a land or circumferential rib located between the pulley grooves and which is an outwardly directed bulge between those grooves. During the formation of the pulley, that land must be supported by internal tooling within the cup, which serves as a back-up as the pulley grooves are being formed. The tooling must be retracted from the land after the formation of the pulley grooves in order to permit removal of the completed pulley from the pulley-making machine. It has been proposed that such tooling be a removable rubber ring in the case of double groove pulleys formed by segmented, outer pulley groove forming dies (U.S. Pat. No. 3,124,090). Other such tooling may be a segmented and expandable inner die employed in a spinning operation (U.S. Pat. No. 2,892,431).

It has been found that when using an internal segmented die to back the land, the segmented die tends to stick in the groove after the crushing operation, since its retracting garter spring is not sufficiently strong to remove the segmented die from its wedged condition. This necessitates the hammering of the blank to free it from the die. A further disadvantage of segmented internal dies is the fact that many of those dies leave tooling marks on the pulley and provide a land which is not truly concentric.

As was stated above, the other type of internal tooling for forming the land between adjacent pulley grooves is a rubber block that will tend to expand into the land upon the application of axial pressure to the cup and which will return to a contracted position when the pressure is no longer applied. Although such rubber blocks do not tend to score the cup, they require frequent replacement and tend to change their dimensions upon repeated machine cyclings.

An acceptable solution to the problem of supporting the land during a groove forming operation is found in U.S. Pat. No. 3,953,995. In that patent there are provided techniques for forming a bulge in the sidewall of a cup-shaped blank while crushing the blank between axially closing dies. As the blank is being crushed, at least two rolls are translated radially into contact with the outer surface of the blank sidewall while the blank is being rotated to form at least two annular pulley grooves in the sidewall of the blank. During the translation, a forming roll is positioned within the blank and is radially shifted away from the longitudinal axis of the cup and into contact with the inner sidewall to form a land between pulley groove pairs.

In substantially all operations involving the formation of grooves in single or multiple groove pulleys, a roughing roll is provided to initially form a groove or grooves in the pulley sidewall and then in a second operation a finish roll or rolls are employed to form the finished groove. Such a two-stage operation is necessary since the finish roll or rolls have relatively sharp peripheries which would tend to thin, or even part, the metal if a drastic one-stage groove-forming operation were employed.

Therefore, the foregoing technique was broken down into a two-stage operation, wherein a rough rolling operation was performed at one station and a finish rolling operation was performed at another station. This situation necessarily lengthens the production cycle time and increases the unit cost of the pulley, which is a low profit margin item. The cycle time to produce single groove pulleys has been drastically shortened by the arrangement shown in U.S. Pat. No. 3,831,414. In that patent, a rough roll is moved slightly in advance of the finish roll to deform the sidewall of the blank in a working operation and partially form the pulley groove while the second forming roll is disposed within the partially formed groove in an idling operation. At the completion of its working operation, the rough roll is disengaged from the partially formed pulley groove and the finish roll is substantially simultaneously moved into a working operation with a negligible amount of non-working, radial travel. The finish roll is then continuously advanced to an imaginary circle having a diameter equal to the desired root diameter of the pulley groove to cooperate with axially movable die members at their final apposition to completely define the cross section of the pulley being formed. Of course, a single groove operation is not as complex as a double groove forming operation, since there is no necessity for an inner forming member, such as a roller or a segmented die.

SUMMARY OF THE INVENTION

This invention provides an apparatus for forming a multigroove pulley from a cup-shaped metal blank having a cylindrical sidewall. The apparatus includes opposed, axially movable die members for applying axial pressure to the blank and rough and finish rollers for sequentially applying radially inwardly directed rolling pressure around the circumference of the cylindrical sidewall of the blank to form one or more pulley grooves connected by a land or land portions. An inner roll supports the land or lands during the forming process. The die members and rolls thereby cooperate to form grooves having the desired root diameter connected to the land or lands and to outwardly flaring wall portions which are axially crushed together by the die members in their closed position to provide the pulley grooves with their ultimate cross sectional configuration.

The axially movable die members engage opposite ends of the cup and spin the cup about its axis. While the cup is spinning, the rough forming rolls are moved into engagement with the sidewall of the cup and begin to form at least two grooves in the sidewall thereof. At the same time that the rough rolls contact the outer sidewall of the cup, an inner roll is shifted from an axially centered position within the cup to a position wherein the inner forming roll just touches the inner sidewall of the cup at a point diametrically opposed to the point of engagement of the rough forming rolls. As the rough forming rolls advance toward the axis of the cup, finish forming rolls are moved into the grooves being formed, but do not engage the sidewall of the cup since the rough forming rolls are moved slightly in advance of the finish forming rolls so that the finish forming rolls are disposed within the partially formed grooves in an idling operation. At the completion of its working operation, the rough forming rolls are disengaged from the partially formed pulley grooves and the finish forming rolls are substantially simultaneously moved into a working operation with a negligible amount of non-working, radial travel. The finish forming rolls are then continuously advanced to an imaginary circle having a diameter equal to the desired root diameter of the pulley grooves to cooperate with the axially movable die members at their final apposition to completely define the cross section of the pulley being formed.

The aforementioned forming rolls are carried by associated slide assemblies which are cam-actuated to provide movement of the rough and finish forming rolls toward the longitudinal axis of the pulley blank and to provide movement of the inner forming roll away from the longitudinal axis of the pulley blank. The camming actuation is provided by cam arms arranged for corresponding, parallel movement with the closing action of the axially movable die members. The slide assemblies are resiliently biased against the cam actuation and upon completion of the camming movement, the assembly is returned to retracted, laterally spaced positions relative to the axially movable die members. This camming arrangement is relatively simple, since, surprisingly, the inner forming roll need not engage the inner sidewall of the cup at an area adjacent the area of engagement of the rough forming rolls, but may be in a position to back the final working of the blank by the finish forming rolls.

DETAILED DESCRIPTION OF THE INVENTION

Figure 1:
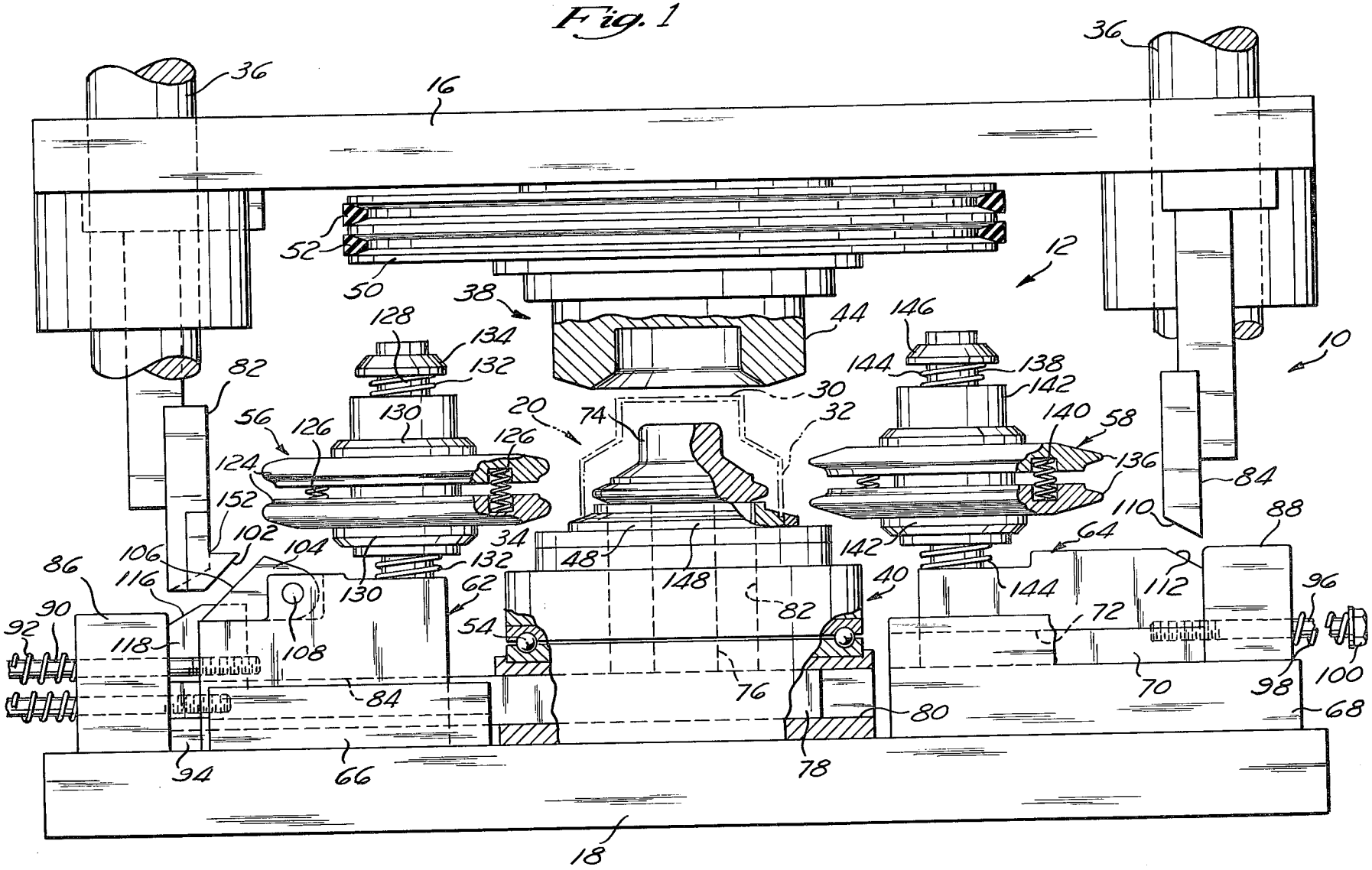
FIG. 1 is a front elevational view, partially in section, of a pulley forming apparatus according to the present invention.

Referring now to the drawings, and particularly to FIG. 1, a press 10 having a pulley forming apparatus 12 mounted therein is illustrated. The press 10 may be a conventional punch press including a frame structure 14, a ram plate or member 16 fixed to a ram (not shown), and a fixed lower bed or bolster plate or member 18. In FIG. 1, the press is shown in a partially open position, with the ram plate 16 raised and a pulley blank 20 positioned within the pulley forming apparatus.

The pulley blank 20 is preformed and has a cup-shape. The blank is formed of metal, and has a closed end 30, an axially extending, cylindrical sidewall 32, and an opposed open end defined by the terminating edge 34 of the sidewall. The plate 16 is movable relative to the plate 18 and is guided in this movement by four corner posts 36 which slidably extend through the plate 16. The pulley forming apparatus includes an axially movable member 38 and a member 40 which are respectively secured to the plate 16 and to the plate 18. The members 38 and 40 are arranged for axially closing movement upon advance of the ram plate 16 toward the plate 18 along the guideposts 36. Of course, either or both of the plates may be arranged for movement toward one another in order to close the members 38 and 40.

The members 38 and 40 are respectively provided with an upper die member 44 and a lower die member 48. Upon movement of the members 38 and 40 to their closed, final apposition, the die members 44 and 48 cooperate to define a die cavity corresponding to portions of the pulley to be formed.

The members 38 and 40 are axially aligned and mounted for rotation about their common longitudinal axis, which corresponds to the axis of the blank and the pulley to be formed. In addition, one or both (preferably one) of the members 38 and 40 may be arranged to be driven in order to establish rotative movement about the axis. As is illustrated, the member 38 is mounted in bearings and carries a double groove sheave 50 which is driven by a motor (not shown) through V-belts 52. The member 40 is mounted on bearings 54 and is rotated by the frictional transmission of torque by the blank during the pulley forming operation.

Figure 2:
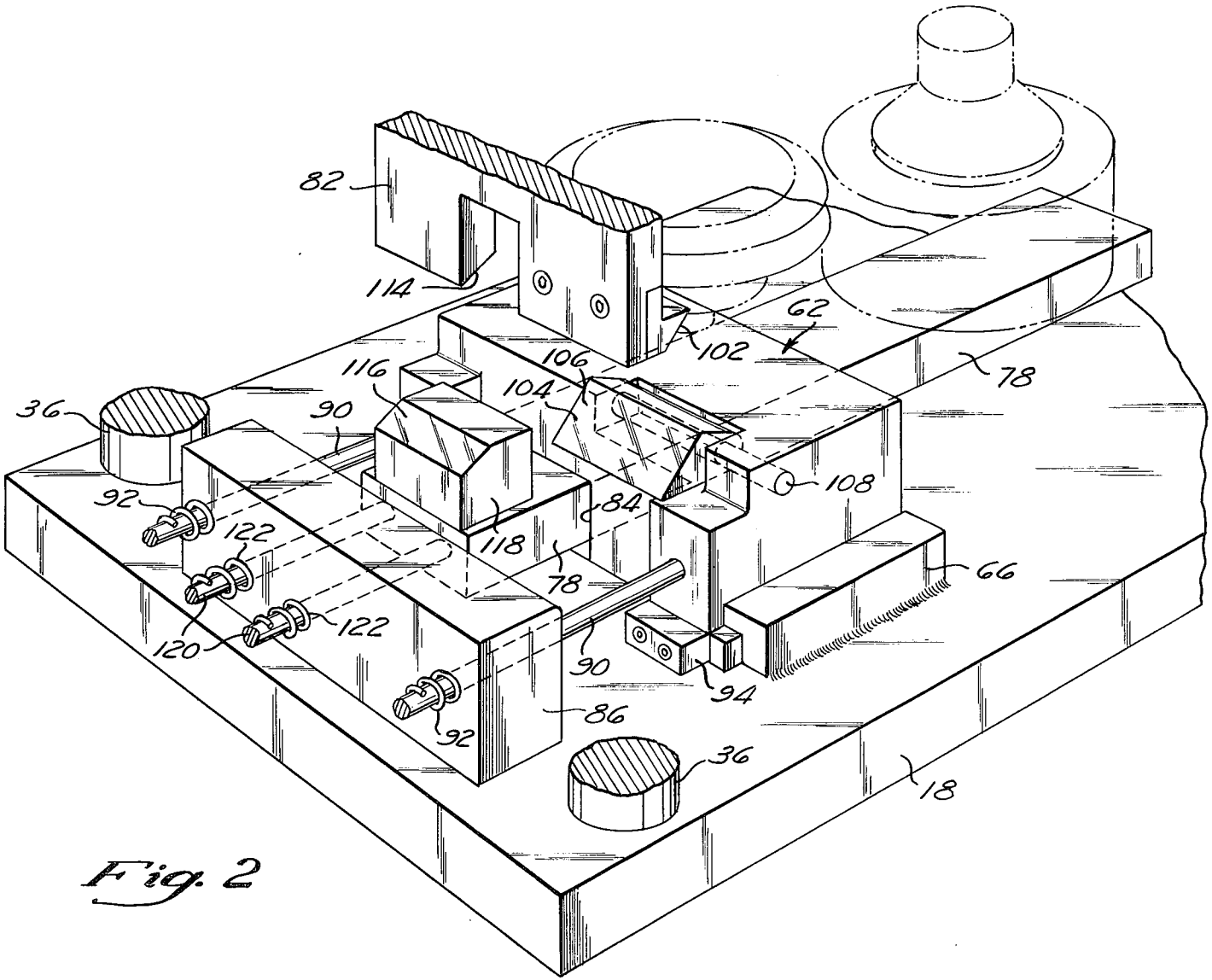
FIG. 2 is a perspective view of the pulley forming apparatus illustrating some of the component parts in nontypical working positions for purposes of clarity.

A rough roll forming member 56 and a finish roll forming member 58 are arranged to be simultaneously advanced at substantially right angles toward the longitudinal axis of the pulley blank, and to cooperate with the members 38 and 40 in the pulley forming operation. The roll forming members 56 and 58 are respectively mounted on slide assemblies 62 and 64. The assembly 62 slides on the base member 18 and is guided by ways 66, as may best be seen in FIG. 2. Similarly, the assembly 64 is mounted for sliding movement on a baseplate 68 which is fixed to the base 18. The slide assembly 64 has laterally projecting flanges 70 which are received within slide panels 72 in the slide assembly. As is set forth in greater detail below, each of the slide assemblies is normally biased to a retracted position clear of the pulley blank as shown in FIG. 1.

There is further provided an inner forming roll 74 which is rotatably mounted on a pedestal 76 so that it lies between the members 38 and 40. The pedestal 76 is fixed to a cross slide 78, which is slidably received within a cross slot 80 in the member 40. The pedestal 76 extends upwardly through a bore 82 in the member 40. The inner forming roll die 76 is normally maintained in an axially centered position, as is shown in FIG. 1. The cross slide extends through a U-shaped channel 84 in the slide assembly 62.

The slide assemblies 62 and 64 and the cross slide 78 are actuated by cam arms 82 and 84, which are rigidly secured to the ram plate member 16. The cam arms 82 and 84 cooperate with associated cam heel blocks 86 and 88, which provide laterally confining bearing surfaces for the cam arms. The cam heel blocks are secured to the baseplate member 18 by means of bolts (not shown).

In addition to providing bearing surfaces for the associated cam arms, the heel blocks are also respectively employed in the biasing of the adjacent slide assembly to its retracted position. Specifically, the slide assembly 62 is threadedly engaged with bolts 90 which extend through the heel block 86 with clearance. The bolts 90 and the slide assembly 62 are resiliently biased to the left, as shown in FIG. 1, into a retracted position by means of springs 92, which are compressively retained between the bolt head (not shown) and the outward surface of the heel block. The retracted movement of the assembly is limited by its interlocking engagement with the guide block 66 and by a bumper 94 fixed to the assembly 62. The slide assembly 64 is similarly biased by bolts 96 and by compression springs 98 extending between the heel block 88 and the bolt heads 100.

The cam arm 82 includes a camming surface 102 arranged to work against a pivot arm 104 having a camming surface 106. As explained in greater detail below, the pivot arm 104 is connected to the assembly 62 by means of a mounting pin 108 and it is arranged to pivot in a clockwise direction, as shown in FIG. 1.

The cam arm 84 is similarly provided with a camming surface 110 arranged to work directly against a camming surface 112 of the slide assembly 64. The associated camming surfaces are arranged to uniformly drive the slide assemblies toward the longitudinal axis of the blank.

The cam arm 82 also includes a camming surface 114 (FIG. 2) arranged to engage a camming surface 116 provided on a cam block 118 which is fixed to the cross slide 78. The cross slide 78 is biased to the left, as viewed in FIGS. 1 and 2, by bolts 120 threaded into the cross slide 78 and by compression springs 122 which extend between the heel block 86 and bolt heads (not shown).

The rough forming roll 56 comprises a pair of rollers 124 biased apart by compression springs 126. The rollers are carried by a fixed shaft 128 extending from the slide assembly 62. The rollers 124 are mounted for rotation about the shaft 128 by means of bearings 130. The rollers are also axially movable relative to the shaft and are resiliently biased to an unloaded position by means of compression springs 132 working between the bearings and the slide assembly 62 and between the bearings and an upper cap 134. Similarly, the finish roll includes a pair of rollers 136 mounted on a fixed shaft 138 and biased apart by compression springs 140. The shaft 138 is fixed to the slide assembly 64. The rollers 136 are mounted for rotation about the shaft 138 by means of bearings 142. The rollers are also axially movable relative to the shaft 138 and are resiliently biased to an unloaded position by means of compression springs 144, which extend between a bearing 142 and the slide assembly 64, and between a bearing 142 and an upper cap 146.

In a pulley forming operation a cup-shaped pulley blank 20 is positioned on the lower die member 48, as shown in FIG. 1. During the loading of the apparatus, the press is in its open position and the plate members 16 and 18, as well as the axially movable members 38 and 40, are axially spaced apart. Further, the slide assemblies 62 and 64 are biased to their laterally retracted positions by the springs 92 and 98, while the inner forming roll 74 is biased to an axially centered position by the springs 122.

A ring member 148 is associated with the lower die 48 and confines the lower edge of the cup during the working operation. After the die has been loaded on the apparatus, one or both of the members 38 and 40 may be rotatably driven in order to establish relative rotation between the blank and the forming roll members.

In the initial stage of the pulley forming operation, the member 38 is brought into crushing engagement with the blank by the closing movement of the ram plate 16. The slide assemblies 62 and 64 are advanced toward the blank by the camming action of their associated camming arms 82 and 84. As the member 38 is brought into engagement with the blank 20, the blank begins to rotate and at the same time the inner roll 74 is brought into engagement with the inner sidewall of the cup. The inner roll merely touches the cup and does not push the sidewall of the cup as it would in a positive working operation. Also at that time, the rough forming rollers 124 are brought into engagement with the sidewalls of the cup and begin to form rough grooves in the sidewall as the cup is foreshortened by the crushing action of the members 38 and 40. It has been found that although the inner roll 74 is not operatively associated with the rough forming rolls on the left side of the cup as viewed in FIG. 1, that roller tends to serve as a backup during the rough forming operation, as is illustrated more particularly in FIG. 3. During the rough forming operation, the rollers 124 move toward each other against the bias of the springs 126.

Figure 3:
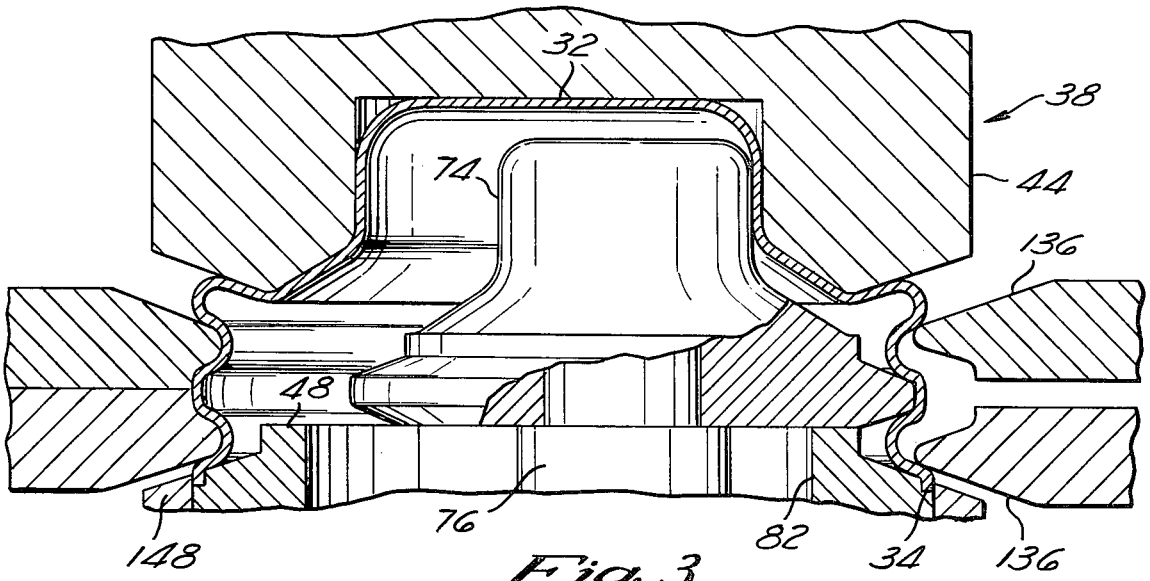
FIG. 3 is a fragmentary, front elevational view of the pulley forming apparatus illustrating the rough forming roll at the end of its working operation.

The rough rollers 124 are moved toward the longitudinal axis of the blank slightly in advance of the finish rollers 136, which, as may be seen in FIG. 3, are captively maintained in the pulley grooves being formed but are not at this stage performing a working operation. Accordingly, during the initial stages of the pulley forming operation, in which the pulley grooves are progressively formed, the finish rollers are engaged within the partially formed pulley groove in an idling, but not working, operation. The idling operation of the finish rollers within the partially formed pulley groove expedites the pulley forming operation by substantially maintaining the finish rollers in a radially advanced and axially aligned position ready to commence their working operations.

The rough rollers 124 may be moved in advance of the finish rollers 136 by simply arranging the cam arm 82 to initiate movement of the slide assembly 62 just prior to the movement of the slide assembly 64. Alternatively, the retracted positions of the slide assemblies 62 and 64, or relative diameters of the rollers 124 and 136, can be varied with appropriate adjustment of the respective cam-actuated movements thereof. Further, the cam angle of the finish roll drive may be arranged to initially move the finish roll at a slightly slower lateral advance rate than the rough rollers, and upon interchange at a slightly greater rate.

Figure 4:
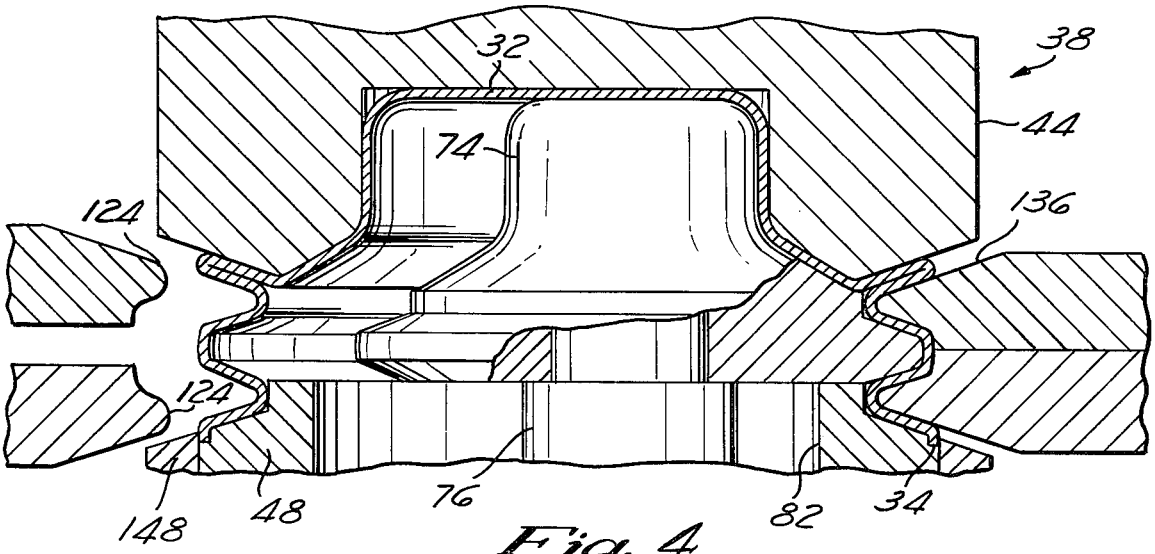
FIG. 4 is a fragmentary, front elevational view of the pulley forming apparatus illustrating the finish forming roll at the end of its working operation.

In FIG. 3 the rough rollers 124 have reached the extent of their radial travel and are about to be retracted to a nonworking position, as illustrated in FIGS. 1 and 4. Retraction of the rollers 124 obtains when the cam surface 102 slides off the cam surface 106 and passes beneath the pivot arm 104 so that the pivot arm is retracted into a notch 152 in the cam arm 82. Further downward movement of the member 38 forces the rollers 136 into working engagement with the pulley grooves to finally form the pulley to the shape illustrated in FIG. 4.

After completion of the pulley forming operation, the upper plate 16 is raised to permit the inner roll 74 and the rollers 124 and 136 to return to their illustrated positions. Upon upward movement of the member 16 the pivot arm 104 is caused to pivot about its pin 108 and then when the cam arm 82 is cleared, the pivot arm 104 falls by gravity to the position illustrated in FIG. 1.

The invention is not restricted to the slavish imitation of each and every detail set forth above. Obviously, devices may be provided which change, eliminate, or add certain specific details without departing from the scope of the invention.

What is claimed is:

1. A machine for forming a pulley having a plurality of pulley grooves of given cross section from a pulley blank in the form of a cup, each groove being defined by pulley wall means connected through the root of the groove and each groove being separated from an adjacent groove by a land, comprising axially movable members for engaging said blank adjacent opposed axial ends thereof, means to axially advance at least one of said axially movable members toward the other to a final apposition at which they define a die cavity, first and second rotatably mounted roll die means, said first roll die means including a first forming roll translatable toward the longitudinal axis and the outer sidewall of the cup along a path defined by a first imaginary line connecting a center of rotation of said forming roll and said longitudinal axis and having a periphery adapted to roll form the periphery of the blank to a desired configuration, said second roll die means having a second forming roll positioned between said axially movable members, being translatable away from the longitudinal axis and toward the inner sidewall of the cup along a path defined by a second imaginary line connecting the center of rotation of said second roll die means and said longitudinal axis, and having a periphery adapted to complement the periphery of said first roll die means and to roll form the periphery of the blank to said desired configuration, said first and second imaginary lines being at an angle of greater than 0° with respect to each other, means to establish relative rotation between said pulley blank and said forming rolls, first roll die moving means to advance said first roll die means from a retracted position toward said longitudinal axis to its forming position at which it defines a die cavity corresponding to further portions of a desired configuration, second roll die moving means to advance said second roll die means away from said longitudinal axis toward the inner sidewall of the cup and to said forming position at which it and said first roll die means together define said further portions of said desired configuration.

2. A machine for forming pulleys according to claim 1, wherein said first roll die means further includes a third forming roll translatable toward the longitudinal axis and the outer sidewall of the cup along a path defined by a third imaginary line connecting a center of rotation of said another forming roll and said longitudinal axis and having a periphery adapted to roll form the periphery of the blank to a desired configuration.

3. A machine for making pulleys as set forth in claim 2, wherein said third imaginary line is at an angle of 180° with respect to said first imaginary line.

4. A machine for making pulleys as set forth in claim 2, wherein said third imaginary line is at an angle of 0° with respect to said second imaginary line.

5. A machine for making pulleys as set forth in claim 2, wherein said roll die moving means includes means to progressively move said first forming roll in advance of said third forming roll to deform said cup wall in a working operation and partially form said pulley groove while maintaining said third forming roll disposed within said partially formed pulley groove in an idling operation, and disengagement means for removing said first forming roll from working engagement with the partially formed pulley groove prior to the disposition of said axially movable members in said final apposition, said roll die moving means including means to further advance said third forming roll in a working operation toward said longitudinal axis to an imaginary circle having a diameter equal to the root diameter of the desired pulley groove to cause said third forming roll and said axially movable members at their final apposition to completely define said die cavity.

6. A machine for forming a pulley according to claim 2, wherein said first and third roll die means have pairs of spaced projecting, V-shaped peripheries, and wherein said second roll die means has a projecting V-shaped periphery adapted to enter the space between the spaced pair of peripheries on the third roll die means.

7. A machine for forming a pulley according to claim 2, wherein said roll die moving means are movable in response to movement of said axially movable members toward and away from each other.

8. A machine for forming a pulley according to claim 2, wherein said axially movable members are fixed to and movable with upper and lower platens and wherein said roll die moving means comprise first, second, and third cross slide members respectively fixed to said first, second, and third roll die means and slidable along said lower platen, a cam member fixed to each slide member and cooperating with cam members fixed to the upper platen and adapted to engage the cam members fixed to the slide members to translate said first, second, and third roll die means.

* * * * *